US009110420B2

(12) United States Patent
Sato

(10) Patent No.: US 9,110,420 B2
(45) Date of Patent: Aug. 18, 2015

(54) IMAGE FORMING SYSTEM

(71) Applicant: KYOCERA Document Solutions Inc., Osaka-shi, Osaka (JP)

(72) Inventor: Masaoki Sato, Osaka (JP)

( * ) Notice: Subject to any disclaimer, the term of this patent is extended or adjusted under 35 U.S.C. 154(b) by 0 days.

(21) Appl. No.: 14/288,256

(22) Filed: May 27, 2014

(65) Prior Publication Data

US 2014/0356012 A1 Dec. 4, 2014

(30) Foreign Application Priority Data

May 31, 2013 (JP) ..... 2013-114872

(51) Int. Cl.
*G03G 21/00* (2006.01)
*G03G 15/00* (2006.01)

(52) U.S. Cl.
CPC ..... *G03G 15/5016* (2013.01); *G03G 15/5087* (2013.01); *G03G 2215/00109* (2013.01)

(58) Field of Classification Search
CPC ..... G03G 15/5016; G03G 15/5075; G03G 15/5087; G03G 2215/00109
USPC ..... 399/81, 8; 358/1.15
See application file for complete search history.

(56) References Cited

U.S. PATENT DOCUMENTS

2008/0309984 A1* 12/2008 Minami et al. ..... 358/301
2013/0258399 A1* 10/2013 Nanaumi ..... 358/1.15

FOREIGN PATENT DOCUMENTS

JP 2007296833 A 11/2007

* cited by examiner

*Primary Examiner* — Sophia S Chen
(74) *Attorney, Agent, or Firm* — Alleman Hall McCoy Russell & Tuttle LLP

(57) ABSTRACT

An image forming system includes an image forming portion, an image data generation portion, a position information obtaining portion, a position information adding portion, a storage portion, an image data searching portion, and a list display portion. The image forming portion forms an image on a print sheet based on image data. The position information obtaining portion obtains position information associated with a place where the image data has been generated. The position information adding portion adds the obtained position information to the generated image data. The storage portion stores therein the image data to which the position information has been added. The image data searching portion searches for the stored image data based on the position information. The list display portion displays a list of the searched image data as a candidate for the image data to be printed by the image forming portion.

5 Claims, 8 Drawing Sheets

FIG. 5

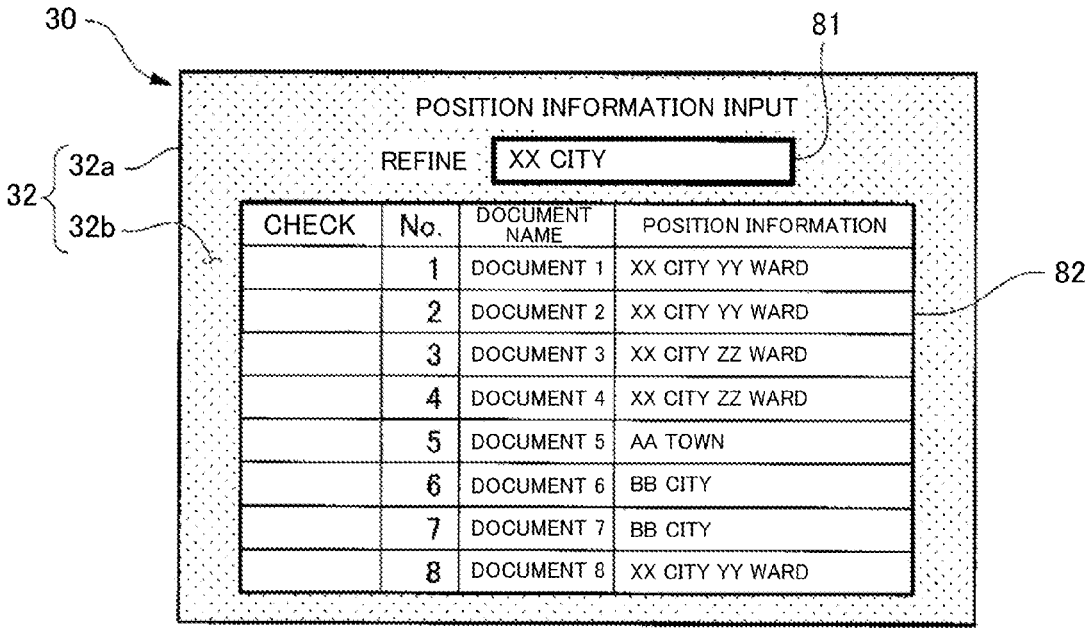

| CHECK | No. | DOCUMENT NAME | POSITION INFORMATION |
|---|---|---|---|
| | 1 | DOCUMENT 1 | XX CITY YY WARD |
| | 2 | DOCUMENT 2 | XX CITY YY WARD |
| | 3 | DOCUMENT 3 | XX CITY ZZ WARD |
| | 4 | DOCUMENT 4 | XX CITY ZZ WARD |
| | 5 | DOCUMENT 5 | AA TOWN |
| | 6 | DOCUMENT 6 | BB CITY |
| | 7 | DOCUMENT 7 | BB CITY |
| | 8 | DOCUMENT 8 | XX CITY YY WARD |

FIG. 6

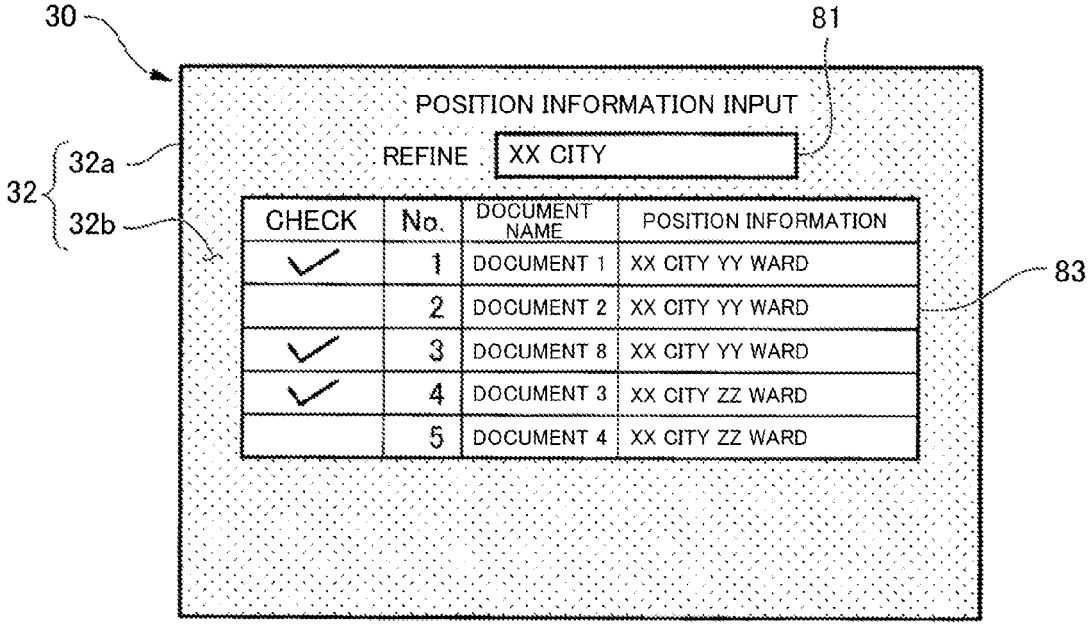

| CHECK | No. | DOCUMENT NAME | POSITION INFORMATION |
|---|---|---|---|
| ✓ | 1 | DOCUMENT 1 | XX CITY YY WARD |
| | 2 | DOCUMENT 2 | XX CITY YY WARD |
| ✓ | 3 | DOCUMENT 8 | XX CITY YY WARD |
| ✓ | 4 | DOCUMENT 3 | XX CITY ZZ WARD |
| | 5 | DOCUMENT 4 | XX CITY ZZ WARD |

IMAGE FORMING SYSTEM

INCORPORATION BY REFERENCE

This application is based upon and claims the benefit of priority from the corresponding Japanese Patent Application No. 2013-114872 filed on May 31, 2013, the entire contents of which are incorporated herein by reference.

BACKGROUND

The present disclosure relates to an image forming system.

In association with recent development of information technology, mobile phones, touch-panel-type tablet devices, and other mobile terminals have become widely used by general users. These mobile terminals have a display portion such as a liquid crystal screen for displaying images. A user can obtain desired information via an image displayed on the display portion or can edit certain text files and programs by operating buttons provided thereto.

As one example of such mobile terminals, a mobile printer that can print a label to be affixed to a building or a structure at a certain spot is known. This mobile printer includes a GPS unit, converts position information obtained from the GPS unit into necessary character string information to be printed out, and generates print information by processing it based on layout information. Then, the mobile printer can print the generated print information on a surface of a label.

In a case where information obtained or edited by the mobile terminal is to be outputted as a printed matter later from a printer placed at home, an office, or the like, a cloud print function (mobile print function) may be used. The cloud print function allows transmission of image data generated by the mobile terminal to a server once, then, access from a printer placed at home or the like to the server, and selection of image data to be printed from among accumulated image data to be printed out.

SUMMARY

An image forming system according to one aspect of the present disclosure includes an image forming portion, an image data generation portion, a position information obtaining portion, a position information adding portion, a storage portion, an image data searching portion, and a list display portion. The image forming portion forms an image on a print sheet based on image data. The image data generation portion generates the image data. The position information obtaining portion obtains position information associated with a place where the image data has been generated. The position information adding portion adds the obtained position information to the generated image data. The storage portion stores therein the image data to which the position information has been added. The image data searching portion searches for the stored image data based on the position information. The list display portion displays a list of the searched image data as a candidate for the image data to be printed by the image forming portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 5 illustrates a display example of a list of image data stored in the server in the first embodiment of the present disclosure.

FIG. 6 illustrates a display example of a list of image data refined based on position information in the first embodiment of the present disclosure.

DETAILED DESCRIPTION

Hereinafter, one embodiment of the present disclosure will be described with reference to the drawings. In the following, an image forming system in which a multifunction peripheral, a mobile terminal, and a server are interconnected via a communication line will be described as an example.

First Embodiment

Figure 1:
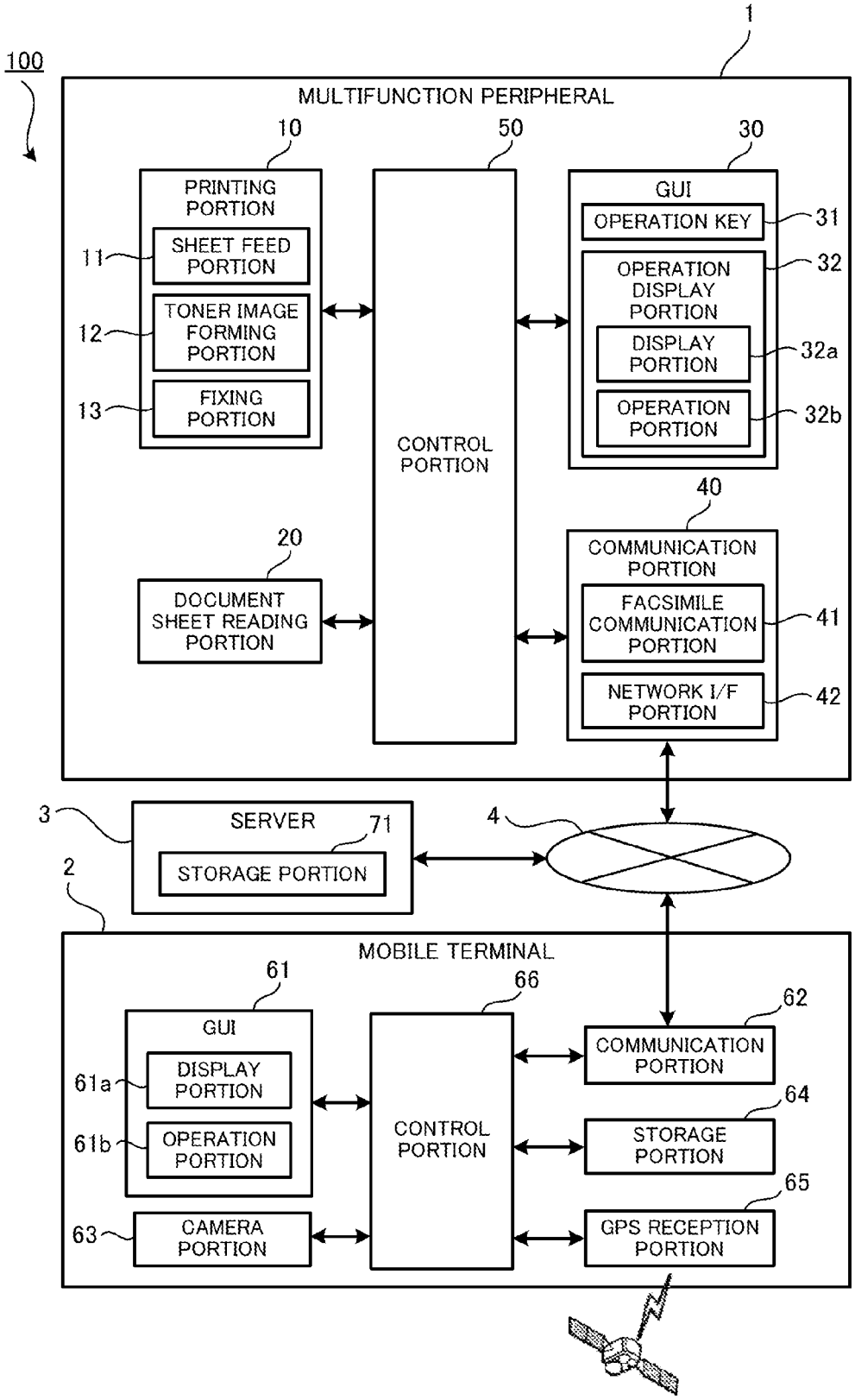
FIG. 1 is a functional block diagram of an image forming system in a first embodiment of the present disclosure.
Figure 2:
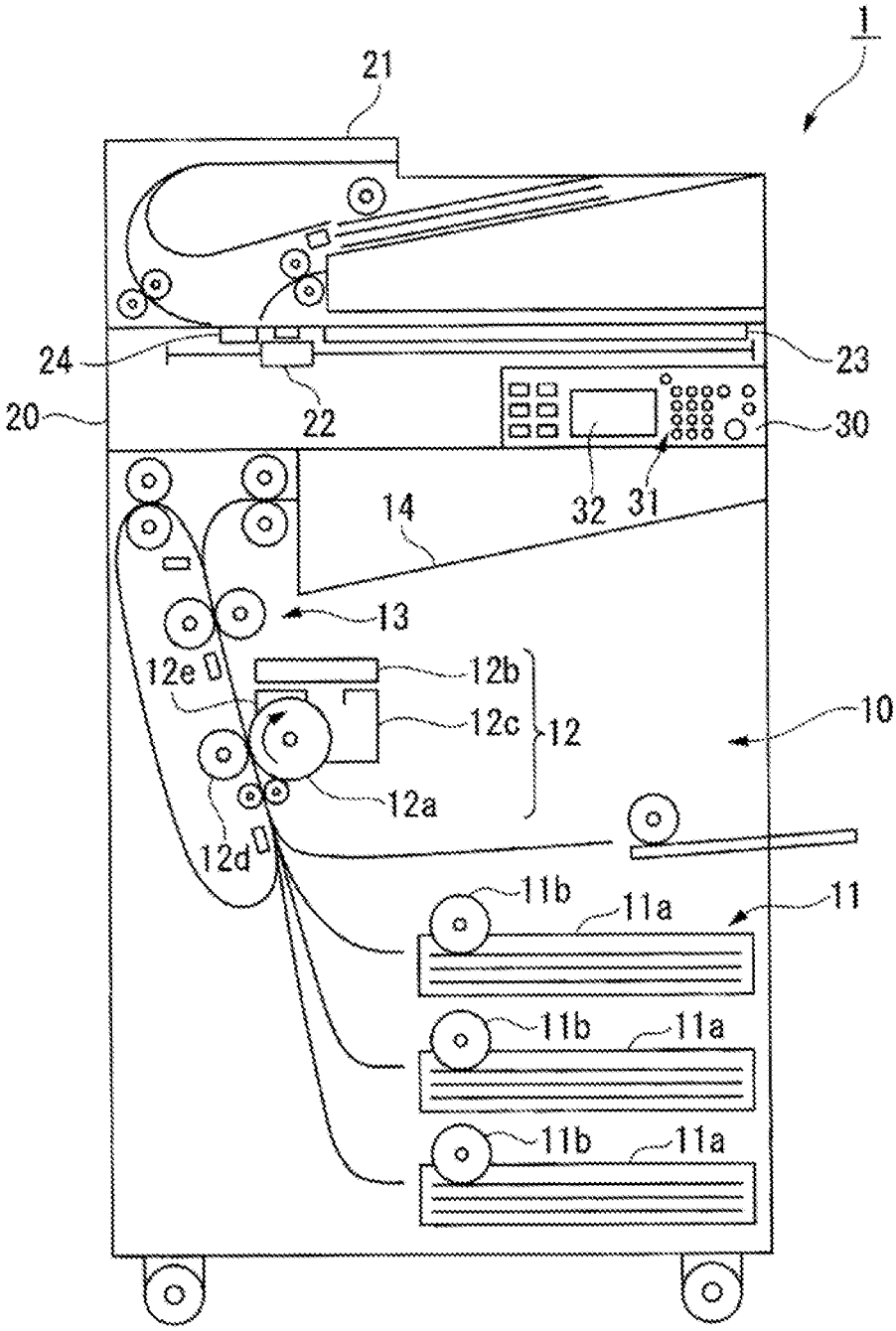
FIG. 2 is a front perspective view showing major parts of a multifunction peripheral in the first embodiment of the present disclosure.

FIG. 1 is a functional block diagram of an image forming system 100 in a first embodiment of the present disclosure. FIG. 2 is a front perspective view showing major parts of a multifunction peripheral 1 in the first embodiment of the present disclosure.

As shown in FIG. 1, the image forming system 100 of the present embodiment includes: the multifunction peripheral 1 (image forming portion, image data searching portion, list display portion); a mobile terminal 2 (image data generation portion, position information obtaining portion, position information adding portion); a server 3 (storage portion); and a communication line 4 interconnecting the multifunction peripheral 1, the mobile terminal 2, and the server 3. The communication line 4 may be a global network or a local network.

The multifunction peripheral 1, which is referred to as MFP, is an image forming apparatus having functions of a copying machine, a printer, a facsimile, and the like. The multifunction peripheral 1 includes a printing portion 10, a document sheet reading portion 20, a GUI (Graphical User Interface) 30, a communication portion 40, and a control portion 50.

The printing portion 10 prints an image on a print sheet, to output the print sheet with the image as a printed matter, under control of the control portion 50. The printing portion 10 includes a sheet feed portion 11, a toner image forming portion 12, a fixing portion 13, a sheet discharge tray 14, and the like. The sheet feed portion 11 includes a plurality of sheet feed cassettes 11*a* which can store a plurality (for example, about several hundreds) of standard-sized print sheets, and which can be drawn from the front face of the multifunction peripheral 1. An uppermost print sheet among the print sheets stored in each sheet feed cassette 11*a* is fed by a pickup roller 11*b* being driven, and is conveyed to the toner image forming portion 12.

The toner image forming portion 12 forms, on the print sheet, a toner image corresponding to an image to be printed, and includes a photosensitive drum 12*a*, an exposure portion 12*b*, a developing portion 12*c*, a transfer portion 12*d*, a charging portion 12*e*, and the like. The photosensitive drum 12*a* is a cylindrical photosensitive member on which an electrostatic latent image corresponding to the image to be printed is formed and which carries a developed toner image. The exposure portion 12*b* applies, to the photosensitive drum 12*a*, laser light by which the electrostatic latent image is formed on a surface of the photosensitive drum 12*a*.

The developing portion 12*c* supplies toner to the photosensitive drum 12*a* having the electrostatic latent image formed thereon, to develop the electrostatic latent image into a toner image. The transfer portion 12*d* transfers the toner image carried by the photosensitive drum 12*a*, onto the print sheet conveyed from the sheet feed portion 11. The charging portion 12*e* applies a voltage to a contact charging portion member such as a charging roller, to charge again the circumferential surface of the photosensitive drum 12*a* after the transfer, thereby causing the circumferential surface of the photosensitive drum 12*a* to be ready for the next electrostatic latent image to be formed thereon by the exposure portion 12*b*.

The fixing portion 13 heats and pressurizes the toner image having been transferred (formed) onto the print sheet by the toner image forming portion 12, to fix the toner image on the print sheet. Thereafter, the print sheet having been subjected to the fixing process is discharged (outputted) to the sheet discharge tray 14 as a printed matter on which a desired image is printed. The sheet discharge tray 14 is a portion on which the printed matters outputted from the fixing portion 13 are accumulated, and is disposed on the printing portion 10.

The document sheet reading portion 20 reads, under control of the control portion 50, a document sheet set by the user, generates a document sheet image data indicating the image of the document sheet (document sheet image), and outputs the generated document sheet image data to the control portion 50. The document sheet reading portion 20 includes an ADF (automatic document feeder) 21, a carriage 22, a document sheet table 23, a document sheet reading slit 24, and the like. The ADF 21 is a device which performs sequential automatic feeding of document sheets to be read. The carriage 22 includes an exposure lamp, a CCD (Charge Coupled Device) sensor, and the like, and reads a document sheet sequentially fed by the ADF 21, or a document sheet set on the document sheet table 23.

Specifically, in a case where a document sheet set on the document sheet table 23 is read, the document sheet is read by the CCD sensor while the carriage 22 is moving in the longitudinal direction of the document sheet table 23. On the other hand, in a case where document sheets fed by the ADF 21 are read, the document sheets sequentially fed by the ADF 21 are read by the CCD sensor through the document sheet reading slit 24, in a state where the carriage 22 is at a position (a position below the document sheet reading slit 24) opposing the document sheet reading slit 24.

The GUI 30 outputs, to the control portion 50, a signal (operation signal) corresponding to an operation by the user, and displays various information such as information indicating the state of the multifunction peripheral 1 in accordance with control by the control portion 50. The GUI 30 includes operation keys 31 and an operation display portion 32. The operation keys 31 are hard keys such as a copy start key, a copy stop/clear key, a numerical keypad (number input keys), a function switching key, and the like. The function switching key is provided for the user to switch the operation mode of the multifunction peripheral 1 to intended one of the copying function, the printing function, the scanning function, and the facsimile function realized by the multifunction peripheral 1.

The operation display portion 32 includes a display portion 32*a* which displays a certain image, under control of the control portion 50, and an operation portion 32*b* which outputs, to the control portion 50, an operation signal corresponding to an operation made on the display screen of the display portion 32*a*. The display portion 32*a* is, for example, a liquid crystal panel or an organic EL panel. The operation portion 32*b* is, for example, a touch panel disposed so as to face the display screen of the display portion 32*a*, and outputs a signal indicating the coordinates of a portion pressed by the user, as the aforementioned operation signal.

The communication portion 40 communicates with an external device, and includes a facsimile communication portion 41 and a network I/F portion 42. The facsimile communication portion 41 is connected to a public telephone line and communicates with a facsimile at the other end. The network I/F portion 42 is connected to the communication line 4, and communicates with an external device such as the mobile terminal 2 or the server 3 also connected the communication line 4.

The control portion 50 comprehensively controls the overall operation of the multifunction peripheral 1, based on an operation signal inputted from the GUI 30 and a signal received from an external device via the communication portion 40. The control portion 50 includes a CPU (Central Processing Unit), a ROM (Read Only Memory), a RAM (Random Access Memory), an interface circuit which performs input/output of a signal to/from the above component portions, and the like.

The mobile terminal 2 includes a GUI 61, a communication portion 62, a camera portion 63, a storage portion 64, a GPS (Global Positioning System) reception portion 65, and a control portion 66. The mobile terminal of the present embodiment is implemented by a touch-panel-type tablet device.

The GUI 61 outputs, to the control portion 66, a signal (operation signal) corresponding to an operation by the user, and displays various information in accordance with control by the control portion 66. The GUI 61 includes a display portion 61*a* and an operation portion 61*b*.

The display portion 61*a* displays a certain image under control of the control portion 66, and is implemented by a liquid crystal display, an organic EL display, or the like. The operation portion 61*b* outputs, to the control portion 66, an operation signal corresponding to an operation made on the display screen of the display portion 61*a*. The operation portion 61*b* is a touch panel disposed so as to face the display screen of the display portion 61*a*. The operation portion 61*b* outputs a signal indicating coordinates of a portion pressed by the user, as the operation signal.

The communication portion 62 transmits/receives various information to/from an external device via the communication line 4, under control of the control portion 66. The communication portion 62 of the present embodiment performs wireless communication using a radio wave.

The camera portion 63 takes an image of an object under control of the control portion 66 based on an operation signal from the GUI 61. The camera portion 63 is implemented by a digital camera using a CCD image sensor or a CMOS image sensor.

The storage portion 64 stores therein various application software and system software. Moreover, the storage portion 64 stores therein image data (picture data taken by the camera portion 63, text data edited by use of application software, and the like) of an image to be printed in the multifunction peripheral 1.

The GPS reception portion 65 receives a signal from a satellite and obtains position information of a current position of the mobile terminal 2. The GPS reception portion 65 obtains position information such as the latitude and longitude, a specific address, the postal code, and the like, by use of various application software (for example, map software), under control of the control portion 66.

The control portion 66 comprehensively controls the overall operation of the mobile terminal 2, based on an operation signal inputted from the GUI 61 and a signal received from an external device via the communication portion 62. The control portion 66 includes a CPU (Central Processing Unit), a ROM (Read Only Memory), a RAM (Random Access Memory), an interface circuit which performs input/output of a signal to/from the above component portions, and the like.

The server 3 includes a storage portion 71 which stores certain data therein. The server 3 has a storage function for a cloud print function in the image forming system 100 of the present embodiment. That is, in response to a request from the mobile terminal 2, the server 3 stores therein image data to be printed in the multifunction peripheral 1.

The image forming system 100 having the above configuration includes the multifunction peripheral 1 which forms an image on a print sheet based on image data. In the image forming system 100, certain image data is generated in the mobile terminal 2, position information associated with the place where the image data has been generated is obtained via the GPS reception portion 65, the obtained position information is added to the generated image data, the image data to which the position information has been added is stored in the server 3. Then, on a later date, the multifunction peripheral 1 is operated to search for the stored image data, based on the position information, and a list of the searched image data is displayed as print candidates, on the GUI 30.

Such operation of the image forming system 100 will be specifically described in the following.

Figure 3:
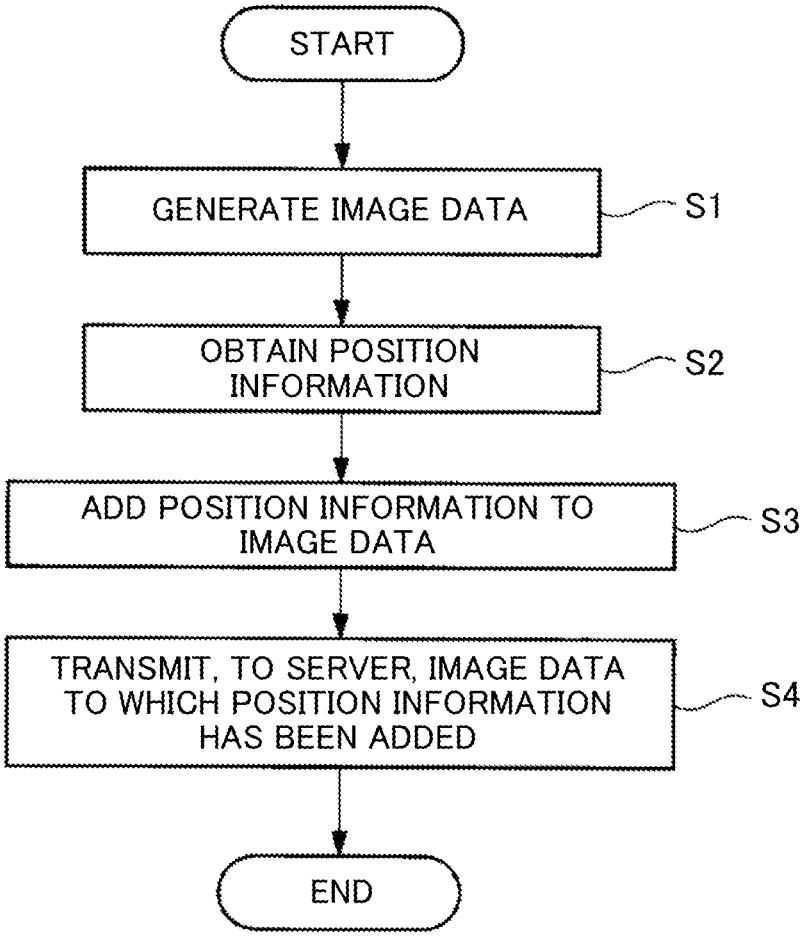
FIG. 3 is a flow chart showing operation (a sequence of various processes relating to a cloud print function up to when image data generated in a mobile terminal is transmitted to a server) of the image forming system in the first embodiment of the present disclosure.
Figure 4:
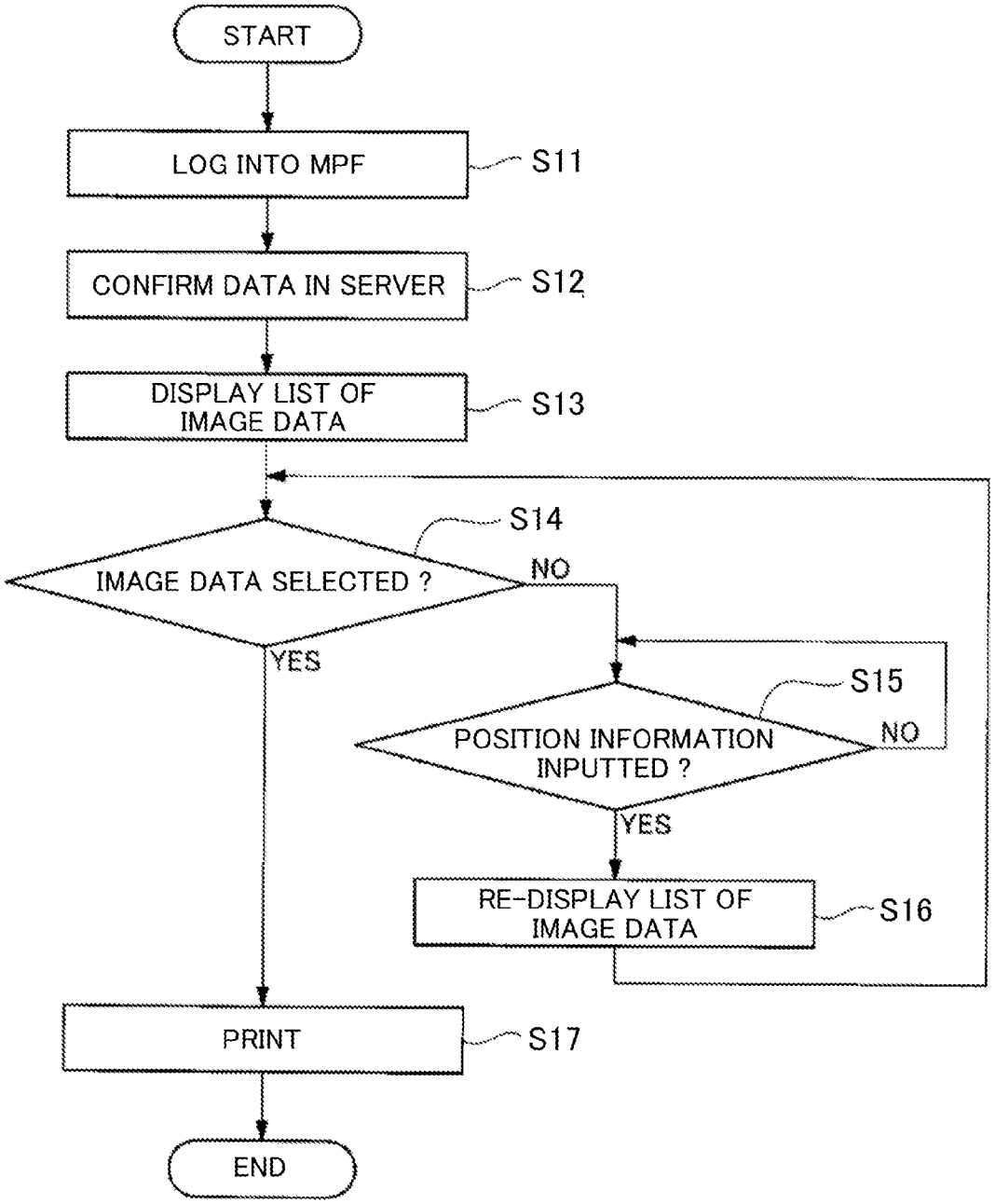
FIG. 4 is a flow chart showing operation (a sequence of various processes relating to the cloud print function from when the multifunction peripheral accesses the server to when desired image data is printed) of the image forming system in the first embodiment of the present disclosure.

FIG. 3 is a flow chart showing operation (a sequence of various processes relating to the cloud print function up to when image data generated in the mobile terminal 2 is transmitted to the server 3) of the image forming system 100 in the first embodiment of the present disclosure. FIG. 4 is a flow chart showing operation (a sequence of various processes relating to the cloud print function from when the multifunction peripheral 1 accesses the server 3 to when desired image data is printed) of the image forming system 100 in the first embodiment of the present disclosure.

The flow chart in FIG. 3 shows the sequence of processes from when the user operates the mobile terminal 2 at a destination to generate certain image data to when the image data is transmitted to the server 3. The flow chart in FIG. 4 shows the sequence of processes when the user returns home (returns to his or her office) and selects desired image data from among a large number of pieces of image data stored in the server 3 to print the selected desired image data.

As shown in FIG. 3, first, in step S1, a process of generating image data is performed in the mobile terminal 2 (image data generation portion). Based on an operation signal inputted from the GUI 61, the control portion 66 generates certain image data. For example, the control portion 66 activates the camera portion 63 based on an operation signal inputted from the GUI 61, and generates image data such as a scenery picture of the destination. Alternatively, for example, the control portion 66 activates text editing application software based on an operation signal inputted from the GUI 61, and generates image data such as a report of a meeting at the destination.

In the next step S2, a process of obtaining position information is performed in the mobile terminal 2 (position information obtaining portion).

By means of the GPS reception portion 65, the control portion 66 obtains position information associated with the place where image data has been generated. Specifically, the control portion 66 obtains, as the position information, position information received by the GPS reception portion 65 at the timing when the generated image data is stored in the storage portion 64.

In the next step S3, a process of adding the position information obtained by the mobile terminal 2 to the generated image data is performed (position information adding portion).

The control portion 66 adds the position information obtained in step S2 to the generated image data, and stores the resultant image data in the storage portion 64. The position information added to the image data here may be information including a specific address or postal code generated through conversion by the map software, or may be position information such as the latitude and longitude. For example, if the size of data becomes large, it is preferable that coordinate data having a relatively small size such as the latitude and longitude is added as the position information.

In the next step S4, in order to store, in the server 3, the image data to which the position information has been added in the mobile terminal 2, a process of transmitting the image data to the server 3 is performed (storage portion).

Based on an operation signal inputted from the GUI 61, the control portion 66 transmits, to the server 3, the image data to which the position information has been added, along with ID information allocated to the mobile terminal 2. In response to a request from the mobile terminal 2, the server 3 accumulates, in the storage portion 71, the image data to which the position information has been added, along with the ID information.

The above is the sequence performed at the destination. In the following, a sequence after the user has returned home (returned to his or her office) will be described.

As shown in FIG. 4, first, in step S11, log-in (personal authentication) is performed by the multifunction peripheral 1.

Based on an operation signal inputted from the GUI 30, the control portion 50 performs personal authentication of the user. The personal authentication is performed by determining whether an ID registered for each user in advance matches the ID inputted via the GUI 30.

In the next step S12, confirmation of data in the server 3 is performed by the multifunction peripheral 1.

Based on log-in information, the control portion 50 confirms whether the user transmitted data to the server 3 in the past. In response to a request from the multifunction peripheral 1, the server 3 discloses accumulated information of image data stored in the storage portion 71.

In the next step S13, display of a list of image data is performed by the multifunction peripheral 1.

The control portion 50 displays a list of image data that the user stored in the server 3 in the past, on the display portion 32*a* of the GUI 30 as shown in FIG. 5. On the display portion 32*a*, a search field 81 (described later) and a list 82 of image data are displayed. The list 82 is provided with a check field, a field of display number, a field of document name of image data, and a field of position information.

In the next step S14, determination of whether image data has been selected is performed by the multifunction peripheral 1.

Based on an operation signal inputted from the GUI 30, the control portion 50 detects whether image data to be printed has been selected. Specifically, when a check field in the list 82 is pressed, a signal representing the coordinates is transmitted by the operation portion 32*b* to the control portion 50, and the field is checked, whereby image data to be printed is selected.

When the determination is "YES" in step S14, that is, when the number of pieces of image data accumulated in the server 3 is small, and the desired image data has been able to be selected from the list 82, the process is advanced to step S17, and then, image forming onto a print sheet based on the selected image data is performed in the multifunction peripheral 1 (image forming portion).

On the other hand, when the determination is "NO" in step S14, that is, when the number of pieces of image data accumulated in the server 3 is large, and the desired image data has not been able to be selected from the list 82, the process is advanced to step S15.

In the next step S15, search for image data based on position information is performed in the multifunction peripheral 1 (image data searching portion).

Based on position information inputted from the GUI 30, the control portion 50 searches for image data stored in the server 3. Specifically, the control portion 50 searches for image data having the position information including characters (in the present embodiment, "XX CITY") inputted in the search field 81 shown in FIG. 5. It should be noted that the process of converting the position information into a specific address ("XX CITY" or the like) by use of the map software or the like may be performed when the image data is transmitted to the server 3 at the destination. Moreover, the converting process may be performed when the user has returned home (returns to his or her office) and obtains data from the server 3.

In step S15, whether position information has been inputted in the search field 81 is determined, and when the determination is "YES", the process is advanced to step S16. In step S16, re-display of a list of the searched image data is performed by the multifunction peripheral 1 (list display portion).

The control portion 50 refines candidates for image data to be printed, based on the position information inputted in the search field 81, and displays a list on the display portion 32*a* of the GUI 30 as shown in FIG. 6. On the display portion 32*a*, a list 83 of image data including "XX CITY" in the position information is displayed. In the list 83, based on low-order position information ("YY WARD", "ZZ WARD") of "XX CITY", the arrangement of pieces of image data has been changed and pieces of position information having common low-order position information are grouped.

Next, with reference back to step S14, based on an operation signal inputted from the GUI 30, the control portion 50 detects whether image data to be printed has been selected. Specifically, when a check field of the list 83 is pressed, a signal representing the coordinates is transmitted by the operation portion 32*b* to the control portion 50, and the field is checked, whereby image data to be printed is selected. When the desired image data has been able to be selected from the list 83, the process is advanced to step S17, and image forming onto a print sheet based on the selected image data is performed in the multifunction peripheral 1 (image forming portion).

As shown in the sequences described above, in the present embodiment, when a printed matter based on desired image data is to be outputted from the multifunction peripheral 1, as a technique for finding the desired image data to be printed from among a large number of pieces of image data stored in the server 3, position information associated with the place where the image data was generated is used. A user who has forgotten details of image data itself stored in the storage portion in the past may remember the place where the image data was generated. Therefore, when the user "wants to find the image data generated when he or she went to SS in the past", by inputting position information of the place where the user went in the past, a list of image data linked to the position information can be easily displayed.

Therefore, according to the present embodiment described above, the image forming system 100 is employed which includes: the multifunction peripheral 1 which forms an image on a print sheet based on image data; the mobile terminal 2 which generates image data, obtains position information associated with the place where image data was generated, and adds the obtained position information to the generated image data; and the server 3 which stores image data to which the position information has been added. Then, in the multifunction peripheral 1, the stored image data is searched for based on the position information, and a list of searched pieces of image data is displayed as candidates for image data to be printed. Thereby, when the image data in the server 3 is to be printed, work for selecting the desired image data from among a large number of pieces of image data can be reduced.

Second Embodiment

Next, a second embodiment of the present disclosure will be described. In the description below, the same or like components as those described in the above embodiment are denoted by the same reference numerals, and the description thereof will be simplified or omitted.

In the first embodiment above, a form in which position information obtained at the same time of generation of image data is added to the image data has been described. However, in the second embodiment, a form in which position information obtained at a timing different from the timing of generation of image data is added to the image data will be described.

The second embodiment assumes a case, for example, where the destination was "SS CITY", but the user created a report of a meeting at the destination on the way home or to his or her office from the destination, and image data generated at "TT CITY" on the way home or to the office is transmitted to the server 3.

Figure 7:
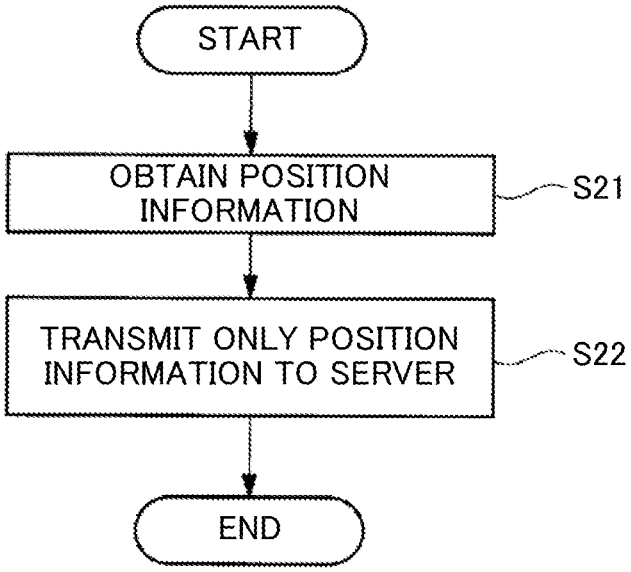
FIG. 7 is a flow chart showing operation (a sequence of various processes relating to the cloud print function up to when image data generated in a mobile terminal 2 is transmitted to a server 3 (especially, a sequence of processes of obtaining only position information of a destination)) of an image forming system 100 in a second embodiment of the present disclosure.
Figure 8:
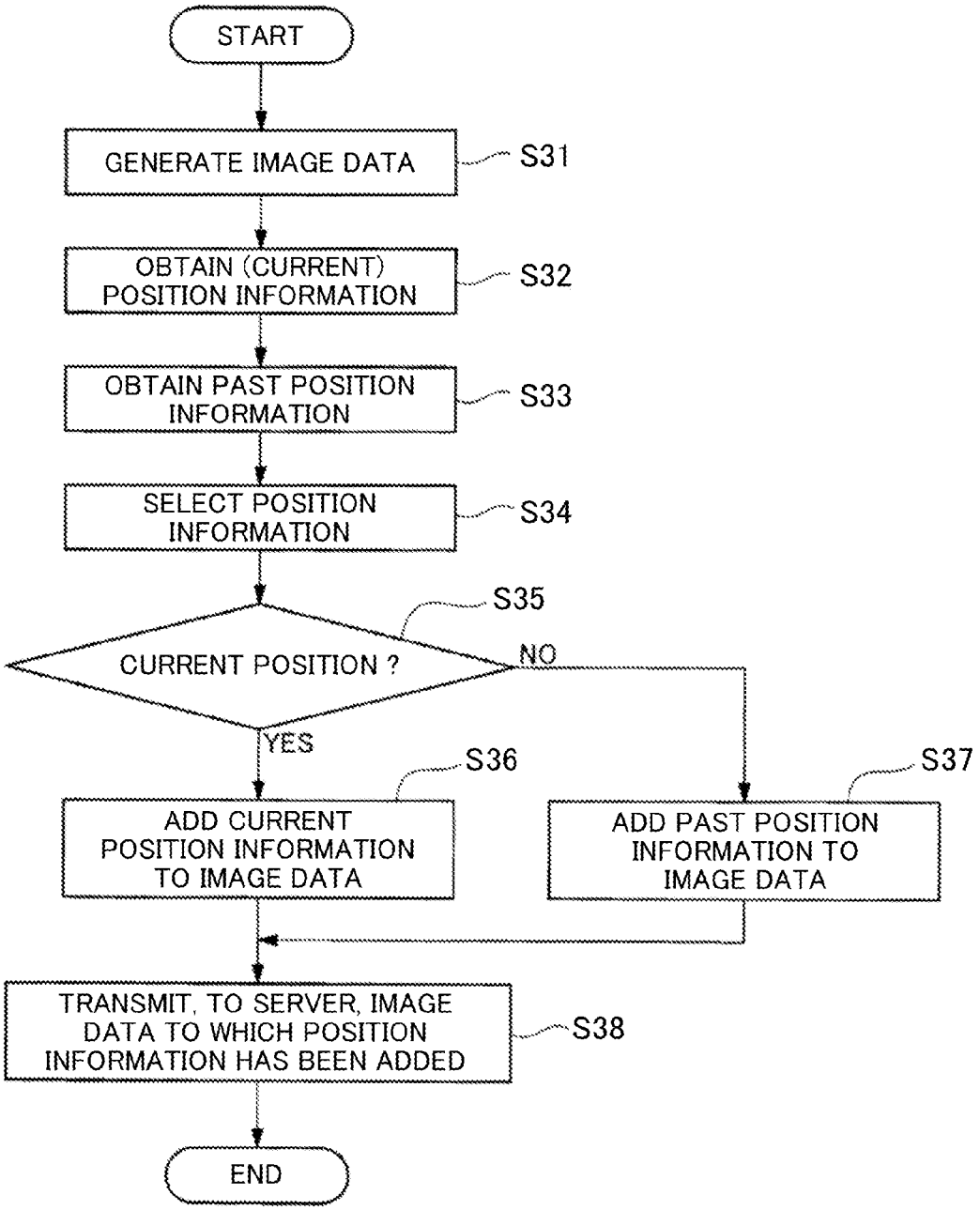
FIG. 8 is a flow chart showing operation (a sequence of various processes relating to the cloud print function up to when image data generated in the mobile terminal 2 is transmitted to the server 3) of the image forming system 100 in the second embodiment of the present disclosure.

FIG. 7 and FIG. 8 are each a flow chart showing operation (a sequence of various processes relating to the cloud print function up to when image data generated in the mobile terminal 2 is transmitted to the server 3) of the image forming system 100 in the second embodiment of the present disclosure. In particular, the flow chart in FIG. 7 shows the sequence of processes in which the user obtains, at a destination, only position information of the destination.

As shown in FIG. 7, first, in step S21, obtainment of position information is performed by the mobile terminal 2. Based on an operation signal inputted from the GUI 61, the control portion 66 receives designation of the place of which position information is to be obtained, and obtains, by means of the GPS reception portion 65, information of the place where the mobile terminal 2 has been present at the time when the designation has been made (first designation portion). That is, the user obtains the user's position information, by operating the mobile terminal 2 when the user is at the destination.

In the next step S22, transmission of the obtained position information to the server 3 is performed by the mobile terminal 2.

Based on an operation signal inputted from the GUI 61, the control portion 66 transmits, to the server 3, the position information obtained at the destination. That is, the user sends in advance, to the server 3, only the user's position information obtained at the destination, without adding the position information to image data.

These are the sequence of obtaining position information at the destination. In the following, the sequence of generating image data and adding the position information to the image data will be described.

As shown in FIG. 8, first, in step S31, a process of generating image data is performed in the mobile terminal 2 (image data generation portion).

Based on an operation signal inputted from the GUI 61, the control portion 66 generates certain image data. For example, the control portion 66 activates text editing application software based on an operation signal inputted from the GUI 61, and generates image data such as a report of a meeting at the destination.

In the next step S32, a process of obtaining position information is performed in the mobile terminal 2 (position information obtaining portion).

Based on an operation signal inputted from the GUI 61, the control portion 66 receives designation of the place of which position information is to be obtained, and obtains, by means of the GPS reception portion 65, information of the place where the mobile terminal 2 has been present at the time when the designation has been made (second designation by first designation portion). For example, in a case where generation of image data of the report of the meeting took time and thus the report was completed in a taxi on the way home or to the office from the destination "SS CITY", as position information at the time when the image data is transmitted to the server 3 (the timing of storing the image data in the storage portion 64), position information of the current place "TT CITY" is obtained.

In the next step S33, obtainment of past position information stored in the server 3 is performed by the mobile terminal 2.

Figure 9:
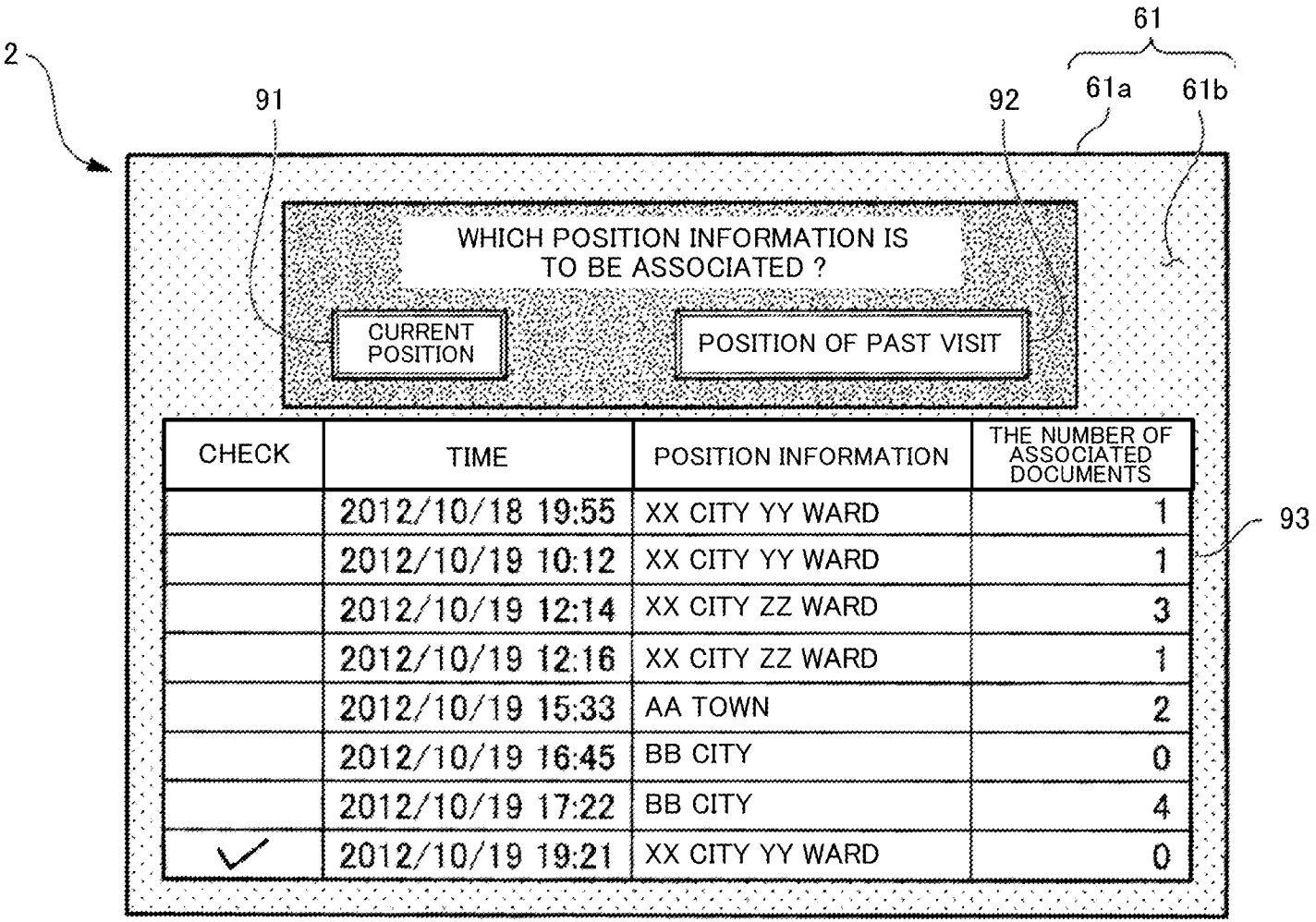
FIG. 9 shows a display example of a list of position information to be added to image data in the second embodiment of the present disclosure.

Based on the ID allocated to the mobile terminal 2, the control portion 66 accesses the server 3 to cause data stored in the storage portion 71 to be disclosed, and displays a list of data that the user stored in the server 3 in the past, on the display portion 61*a* of the GUI 61 as shown in FIG. 9. On the display portion 61*a*, a button 91 for "current position", a button 92 for "position of past visit", and a list 93 of data are displayed. The list 93 is provided with a check field, a time field, a field of position information, and a field of the number of associated documents.

In next step S34, a process of selecting position information to be added to the generated image data is performed in the mobile terminal 2 (second designation portion).

In a case where obtainment of position information has been performed a plurality of times and a plurality of pieces of position information have been obtained, the control portion 66 designates, based on an operation signal inputted from the GUI 61, one piece of position information to be added to the generated image data, from among the plurality of pieces of position information.

In step S35, when the determination is "YES", that is, when the button 91 for "current position" shown in FIG. 9 has been pressed, the process is advanced to step S36.

In the next step S36, the position information (the current position at the timing of storing the image data in the storage portion 64) obtained in step S32 is added to the generated image data, and the resultant image data is stored in the storage portion 64 (position information adding portion).

On the other hand, in step S35, when the determination is "NO", that is, when the button 92 for "position of past visit" shown in FIG. 9 has been pressed, the process is advanced to step S37.

In the next step S37, the position information (position information obtained in the past) obtained in step S21 is added to the generated image data, and the resultant image data is stored in the storage portion 64 (position information adding portion). Specifically, when a check field in the list 93 is pressed, a signal representing the coordinates is transmitted by the operation portion 61*b* to the control portion 66, and the field is checked, whereby the position information that has been obtained in the past and that is to be added is selected. It should be noted that the position information obtained in the past has "0" in the field of the number of associated documents. The reason why "0" is displayed in the field of the number of associated documents is that only the user's position information (position information of the mobile terminal 2) at the destination obtained in step S21 has been sent in advance to the server 3, without being added to any image data (see step S22).

In the next step S38, in order to store, in the server 3, the image data to which the position information has been added in the mobile terminal 2, a process of transmitting the image data to the server 3 is performed (storage portion).

Based on an operation signal inputted from the GUI 61, the control portion 66 transmits, to the server 3, the image data to which the position information has been added. In response to a request from the mobile terminal 2, the server 3 accumulates, in the storage portion 71, the image data to which the position information has been added.

The sequence thereafter is the same as that in the first embodiment, and in accordance with the sequence shown in FIG. 4, the desired image data is printed.

As shown in the sequences described above, in the second embodiment, since past position information (position information of the destination) has been obtained, when image data generated at a different place is to be transmitted to the server 3, the past position information can be added to the image data. That is, in a case where image data was not generated at the destination but the image data is associated with the destination, the user may remember the image data and the destination associated with each other. Therefore, when the user "wants to find the image data generated when he or she went to SS in the past", by inputting position information of the place where the user went in the past, a list of image data linked to the position information can be easily displayed.

Therefore, according to the second embodiment described above, even in a case where the position of the destination (past position) is different from the position (current position) where the image data was stored in the storage portion 64, when the image data on the server 3 is to be printed, work for selecting the desired image data from among a large number of pieces of image data can be reduced.

Although preferred embodiments of the present disclosure have been thus described with reference to the drawings, the present disclosure is not limited to the above embodiments. The shapes, combinations, and the like of the components described in the above embodiments are exemplary ones. Various modifications can be made based on design requirements and the like without departing from the gist of the present disclosure.

For example, according to the second embodiment above, in the list shown in FIG. 9, since position information to be added to image data is not necessarily associated with position information for which the number of associated documents is "0", pieces of past position information are displayed in chronological order. However, the present disclosure is not limited thereto. For example, only position information for which the number of associated documents is "0" may be displayed.

Further, for example, in the above embodiments, a touch-panel-type tablet device has been exemplified as the mobile terminal, but the present disclosure is not limited thereto. For example, the mobile terminal may be a mobile phone, a PDA (Personal Digital Assistant), a notebook PC (Personal Computer), or the like.

Further, for example, in the above embodiments, as image data, picture data taken by the camera portion or text data edited by text editing application software has been exemplified. However, the present disclosure is not limited thereto. For example, the image data may be screen data or the like displayed on a web browser at the mobile terminal at the time when the user searched a product or the like that attracted the user's attention at the destination.

Further, for example, in the above embodiments, the multifunction peripheral has been explained as an example, but the present disclosure is not limited thereto. For example, the present disclosure is applicable to other image forming apparatuses such as a copy machine, a printer, and a facsimile apparatus.

Further, for example, in the above embodiments, a cloud print function has been exemplified as operation of the image forming system, but the present disclosure is not limited thereto. The cloud print function has been explained as an example that effectively utilizes position information, and the image forming system of the present disclosure is applicable to other usages.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming system comprising:

an image forming portion configured to form an image on a print sheet based on image data;

an image data generation portion configured to generate the image data;

a position information obtaining portion configured to obtain position information associated with a place where the image data has been generated;

a position information adding portion configured to add the obtained position information to the generated image data;

a storage portion configured to store therein the image data to which the position information has been added;

an image data searching portion configured to search for the stored image data based on the position information; and a list display portion configured to display a list of the searched image data as a candidate for the image data to be printed by the image forming portion.

2. The image forming system according to claim 1, comprising a first designation portion configured to provide the position information obtaining portion with designation of a place the position information of which is to be obtained.

3. The image forming system according to claim 2, wherein the position information obtaining portion obtains, as the position information, information of a place where the image data generation portion has been present when the designation has been made.

4. The image forming system according to claim 2, comprising a second designation portion configured to, when designation by the first designation portion has been made a plurality of times and the position information obtaining portion has obtained a plurality of pieces of position information, provide the position information adding portion with designation of one piece of the position information to be added to the generated image data from among the plurality of pieces of the position information.

5. The image forming system according to claim 1, wherein the image data generation portion is a mobile terminal.

* * * * *